US007229352B2

(12) United States Patent
Bonito

(10) Patent No.: US 7,229,352 B2
(45) Date of Patent: Jun. 12, 2007

(54) CASINO DICE GAME METHOD AND DEVICE

(76) Inventor: John Bonito, 1847 Stablegate Ave., Henderson, NV (US) 89012

( * ) Notice: Subject to any disclaimer, the term of this patent is extended or adjusted under 35 U.S.C. 154(b) by 685 days.

(21) Appl. No.: 10/649,908

(22) Filed: Aug. 27, 2003

(65) Prior Publication Data

US 2004/0048654 A1 Mar. 11, 2004

Related U.S. Application Data

(60) Provisional application No. 60/407,160, filed on Aug. 29, 2002.

(51) Int. Cl.
*A63F 9/24* (2006.01)

(52) U.S. Cl. ..... 463/22; 463/16; 273/146; 273/274

(58) Field of Classification Search ..... 463/16–20, 463/22; 273/274, 309, 146
See application file for complete search history.

(56) References Cited

U.S. PATENT DOCUMENTS 5,829,748 A * 11/1998 Moore, Jr. ..... 273/274
5,931,471 A * 8/1999 Bonito ..... 273/274
6,394,901 B1 * 5/2002 Marta ..... 463/20
6,655,689 B1 * 12/2003 Stasi ..... 273/274
6,761,353 B2 * 7/2004 Berman et al. ..... 273/143 R
6,802,508 B2 * 10/2004 Moody ..... 273/146

* cited by examiner

*Primary Examiner*—Corbett B. Coburn
(74) *Attorney, Agent, or Firm*—Robert Ryan Morishita; Morishita Law Firm, LLC

(57) ABSTRACT

A player places a point bet. A come out number is randomly selected using dice or a random number generator. Depending on the come out number selected, the player wins the point bet, loses the point bet, pushes on the point bet, or the point bet remains in play and the come out number becomes the point number. Outcome numbers are randomly selected until the outcome number is either 7, in which case the player loses the point bet, or the point number, in which case the player is rewarded. Place bet wagers are provided subsequent to the selection of the come out number on the numbers 5, 6, 8, or 9 (excluding 4 and 10). During the selection of the outcome number, if the outcome number 7 is selected, players lose any place bet wagers, and if the outcome number is the place bet number, the player is rewarded.

23 Claims, 3 Drawing Sheets

CASINO DICE GAME METHOD AND DEVICE

CROSS-REFERENCE TO RELATED APPLICATION

This application claim the priority of prior filed, commonly owned, provisional application ser. No. 60/407,160 filed Aug. 29, 2002 and titled "Casino Dice Game Method and Device".

FIELD OF THE INVENTION

The present invention relates to casino dice games such as craps.

BACKGROUND

Craps is a well known casino dice game. There are numerous wagering possibilities in the game of craps including, but not limited to, whether to wager with the house or the shooter-player, i.e. bet the Pass or Don't Pass line, whether to make place bets, hard way bets, Field wagers, one time proposition wagers, to name but a few. With each new roll there are numerous wagering propositions provided to the players.

A drawback to traditional casino craps is that the game tends to be intimidating to novices. The various wagering possibilities tends to frustrate newcomers to the game. The craps game layout, to accommodate the various propositions, can be confusing thus making new players uncomfortable with trying craps. A further drawback of craps is that the table layout for the game demands a large table structure and thus the game is not suitable to be configured on a smaller Blackjack table.

In my prior patent, U. S. Pat. No. 5,931,471 issued Aug. 3, 1999, the disclosure of which is hereby incorporated by reference, I set forth a simplified version of a craps game.

There continues to be a need for even a more simplified dice game which provides features and advantages including providing at least several wagering propositions for a player, offering rewards at odds ranging from 1:1 to odds greater than 1:1, such as at least 3:1, which incorporates the excitement of the traditional game of craps, which can be played on a Blackjack table thus consuming less floor space than a traditional craps table, which can be played by one or a group of players and which can be incorporated in to a computer operated game. It is believed that the game method and device of the present invention fulfills one or more of the above needs.

SUMMARY OF THE INVENTION

There is, therefore, set forth according to the present invention a casino game method and device which provides a simplified game, a game which is suitable to being played on a Blackjack-size table and which provides the players with awards greater than even money.

Toward this end there is set forth a method for playing a dice game which includes the player making a mandatory point bet to participate in the game. A come out number between 2 and 12 is randomly selected by using, for example, a pair of dice, cards with numerical representations, a random number generator or the like. If the come out number is 7 the method includes paying the player 1:1 based upon the point bet, if the number is 2 or 3 the player loses the point bet, if the number is 11 or 12 the outcome is a push and if the number is 4-6 or 8-10, that number is declared the point number. Outcome numbers are serially selecting until the outcome number is one of a 7 or the point number. If the number is a 7 the player loses their point wager and if the outcome number is the point number the player receives an award based upon their point wager of at least 1:1. The method also includes providing place bet wagers on the numbers of 5-6 and 8-9 (excluding the 4 and 10) and subsequent to selection of the come out number the player making a place bet on one or more of the place bet numbers. During the serial selection of outcome numbers, if the outcome number is a 7 the player loses all place bet wagers and if the outcome number matches a place bet number the method includes rewarding the player at odds greater than 1:1.

Other features includes providing certain "next outcome" proposition wagers such as on the group of numbers 2-4 and 10-12. Another proposition wager which can be offered in on the numbers of 2, 3 and 11. 12 whereby the player may wager to either protect his come out wager against being lost or a push.

Winning outcomes may be rewarded at odds greater that 1:1.

The method and device of the present invention provides an simple and exciting game which can be adapted as a dice game and which can be configured to be played on a standard Blackjack table.

BRIEF DESCRIPTION OF THE DRAWINGS

These and other features and advantages will become appreciated as the same becomes understood with reference to the description, claims and drawings wherein:

DESCRIPTION

Figure 1:
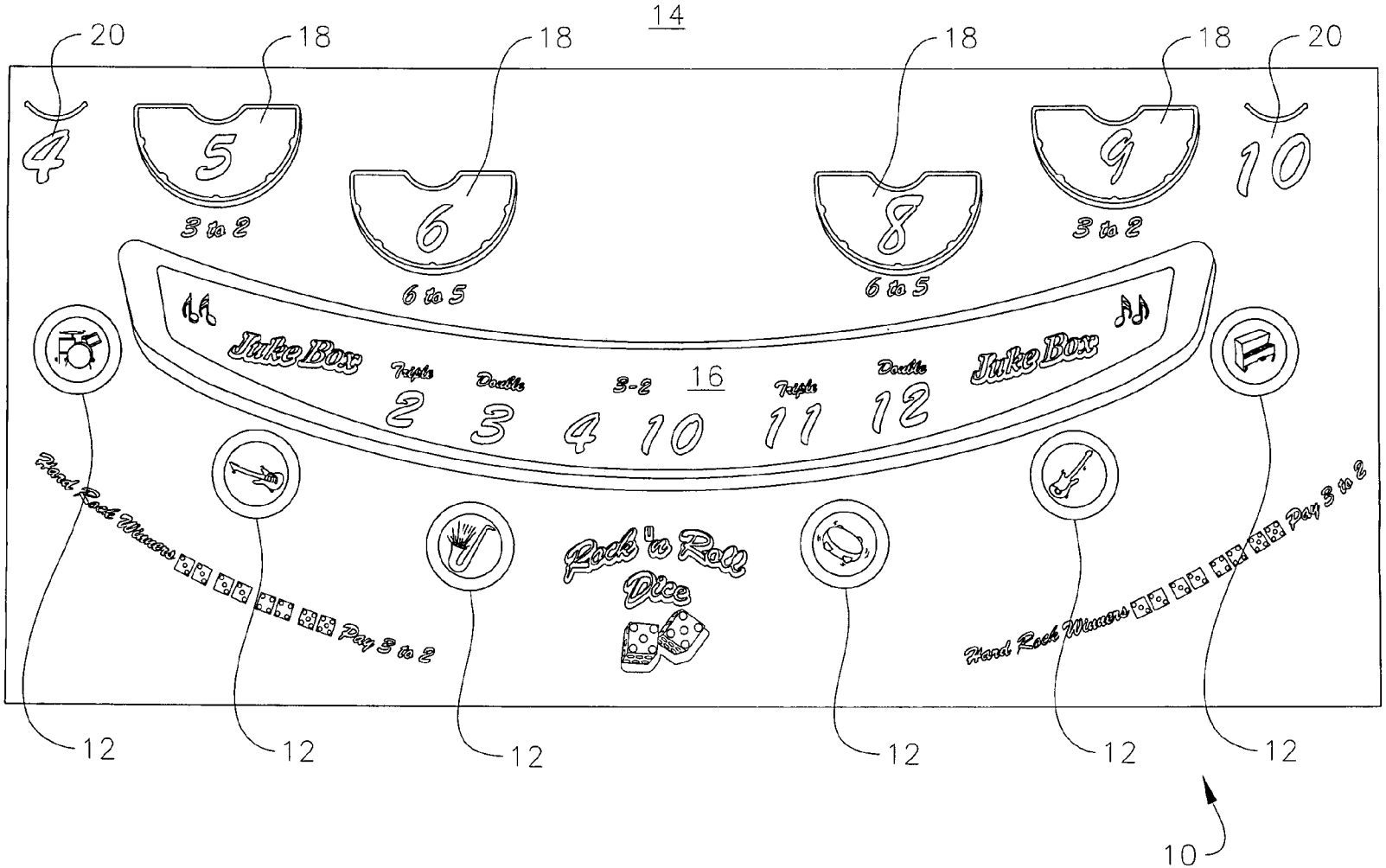
FIG. 1 shows a layout for the play of the game.

Turning to FIG. 1 there is shown a layout 10 for the play of the game method according to the present invention. The layout 10 may be shaped and configured to occupy the top of a similarly configured Blackjack table of the type known in the art. The layout 10 may be printed on a felt or other product, also as is known in the art.

The layout 10 has designs and indicia thereon to control the play of the game and to denote the various wagers available for the game according to the method thereof. As shown in FIG. 1, the layout 10 denotes a plurality of player positions 12 shown as circles, which may bear logos or other indicators. Thus, the layout 10 is configured to accommodate six players of the game. Opposite the player positions is a dealer position 14 occupied by a live dealer for the game. The dealer collects and pays the wagers according to the game method and, according to one embodiment, controls the roll of the dice or other means for selecting outcomes, e.g. processor with random number selection means, dice cage, shaker cup, cards or the like. By having the dealer control the number selection means, there is less chance of tampering with the game.

Disposed between the dealer position 14 and the player positions is a one time proposition bet area 16 which, as illustrated, may be arcuate to follow the pattern of the table and extend to all player positions. The proposition bet area 16 is preferably imprinted with the group of proposition numbers of 2, 3, 4, 10, 11, and 12. These proposition numbers represent a group of numbers upon which the player may bet that the next outcome, e.g. roll of the dice, will be one of the proposition numbers. If the next outcome is not one of those numbers, the one time proposition bet is lost. If it is, the one time proposition bet is won.

Disposed between the proposition bet area 16 and the dealer position 14 are place bet areas 18 for each of the numbers of 5, 6, 8 and 9. The layout 10 may also bear indicia 20 that indicate that the player may not make a place bet on the point numbers of 4 or 10.

With the layout 10 described, the method of play of the game will now be set forth assuming that initially no "point" has yet been established.

To participate in the game, each player must make a mandatory point bet by placing a bet, e.g. $25, in the player position 12 corresponding to that player. During play of the game as hereinafter described, new players may enter the game by simply making the required point bet. After each player has made their point bet, a pair of dice are used to randomly select numbers between 2 and 12. While this description refers to dice it should be understood that one or more decks of cards could be used. Where dice are used, the dice may be thrown, as in traditional craps, or may preferably be shaken or tossed by the dealer to control the integrity of the number selection process. For example, the dice may be tossed using a shaker or spinning cage or any other mechanical means. Alternatively a computer processor and display may be employed to, when prompted by the dealer or a player, randomly select and display a number outcome of 2 to 12. The display may show depictions of a pair of dice to enhance the visual appearance and excitement for the game. The selection of the outcome numbers, whether done mechanically, by selection of a card from a deck, or electronically, will hereinafter be referred to as a "roll" of the dice. Where no "point" has been established for the game as hereinafter described, the first roll of the dice is defined as a "come out" roll. On the come out roll, only the point bets are in play. The come out roll provides a decision with regards to the point and the point bets according to the following protocol.

1. If the come out roll is an outcome of a "7", all point bet players win their point bets and are awarded an even money pay based on their point bet;

2. If the come out roll is a 2 or 3, all players lose their point bets;

3. If the outcome is an 11 or 12, there is no action and the player neither wins nor loses their point bet; and 4. If the outcome is 4-6 or 8-10, the outcome, e.g. a 6, becomes the "Point" number. To denote the Point, a puck or lamer is placed by the dealer on the corresponding number of the indicia 20 (4, 10) or place bet 18 (5-6, 8-9). The dice are continued to be rolled, according to the above protocol, until a point is established. With a point established, the point bet now represents a wager that a subsequent roll of the dice, will produce either a 7 (a point bet losing outcome) or the outcome repeats the point number, e.g. another 6 is rolled. For an outcome of a 7 the player's point bet is lost and is collected by the dealer. If the outcome is the point, the player wins their point bet and receives an award. The award may be an even money award based on the point bet, e.g. a 1:1 pay or may be at odds greater than even money. Preferably, the award is 1:1 and if the winning point outcome is a hard way outcome (only available for the points of 4, 6, 8 and 10), e.g. the dice are a "2-2", or "3-3" or "4-4" or 5-5", the player is paid 3:2.

The dice are sequentially rolled to produce outcomes. As stated above, the point bet will ultimately be resolved as a winning or losing outcome.

The game method also includes other, optional, wagering opportunities for the players which will now be described.

After a point has been established, a player may make a place bet on one or more of the numbers of 5, 6, 8 or 9 (the number of 4 and 10 are excluded). To make a place bet the player instructs the dealer to place their place wager on the selected one (or more) place bets 18. The dealer would place the player's chip(s) on the corresponding place bet area 18 for the player. By making a place bet, the player is wagering that the place bet number will be an outcome before there is a 7 outcome. If a 7 is the outcome before the wagered upon place bet number, the player loses their place bet and the same is collected by the dealer. If the wagered upon place bet number is rolled before a 7, the player wins and receives an award based on their place bet. The award may be paid at odds greater than 1:1. Preferably, and depending upon the number bet upon, the player is paid according to the following schedule which represents the true mathematical odds of the place bet number being rolled as opposed to a 7:

| Place Bet Number | Award (based on wager) |
|---|---|
| 5 or 9 | 3:2 |
| 6 or 8 | 6:5 |

Unlike the traditional games of craps, the numbers of 4 and 10 are not available for place bets.

In the preferred method, where place bets are paid according to the true mathematical odds, the game method preferably includes restricting the amount which can be bet as a place bet. Further, unlike craps, a point bet is required for a player to make a place bet. Thus the game method includes confining the place bet to a multiple, e.g. 1× to 4× of the player's point bet. Alternatively the place bet wagers may be limited by an aggregate equal to, for example, four times the point bet. For example, if the player has a point bet of $25, they may wager up to $100 on one or more of the place bet numbers, e.g. $50 on the 5, $25 on each of the 6 and 8. The player may, after a point has been established, increase their point wager to make increased place bets available.

A further bet which is available to a player (available anytime) is a one roll proposition bet on a group of numbers of 2-4 and 10-12. This bet may be made at any time, e.g. before or after a point has been established. To make the proposition wager, the proposition wager is put in the proposition bet area 16 or the dealer is requested to so. This bet represents the proposition that on the next roll one of the proposition numbers will be the outcome. If the next roll produces one of the proposition numbers the player wins, otherwise they lose their proposition bet. Preferably, for winning proposition bets and depending upon the proposition number rolled, the player may be awarded even money, e.g. 1:1 or at odds greater than even money. For example the proposition wager may have the following pay schedule:

| Proposition Number Rolled | Award |
|---|---|
| 2, 12 | 3 × Bet |
| 3, 11 | 2 × Bet |
| 4, 10 | 3/2 × Bet |

Since the one time proposition bet can be mad at any time, a player can make the proposition bet at the come out roll as a form of insurance to protect the point bet, e.g. if during a come out roll the outcome is a 3, the player would lose their point bet but would win their proposition bet.

In a further or additional embodiment, a second proposition wager may be provided for the player. According to this proposition, the player may make a one roll proposition wager that the next roll will be a 2 or 3, or an 11 or 12 or a combination of 2, 3, 11, or 12. This proposition wager is available before a point has been established, e.g. on the come out roll. This wager provides the player with "insurance" on the come out roll to protect against a losing come out roll of a 2 or 3 or a push outcome of an 11 or 12. Preferably, the award for the second proposition wagers are at odds greater than 1:1. For example, the propositions may be presented and awarded as follows:

| Second Propositions | |
|---|---|
| Proposition | Award (X Second Proposition Wager) |
| 2 or 3 only | 10 X |
| 11 or 12 only | 10 X |
| 2, 3 11 or 12 | 4 X |

Thus if, according to one embodiment, only the 2 or 3 proposition is offered and the player makes the requires second proposition wager and is the outcome is a 2 or 3, the player is paid ten times their second proposition wager. If the game includes the 11 or 12 wager, the same rule would apply. If the second proposition is offered as one embracing the 2, 3 11 or 12 and if the next roll produces one of those numbers, the player would be paid four times their second proposition wager. Thus, for example, the player make a $25 point wager and, for the come out roll, a $10 second proposition wager to protect his $25 wager against either a losing or "push" come out roll.

Other than the bets described above, and for the simplicity of the game of the present invention, no other bets or propositions are available.

Figure 2:
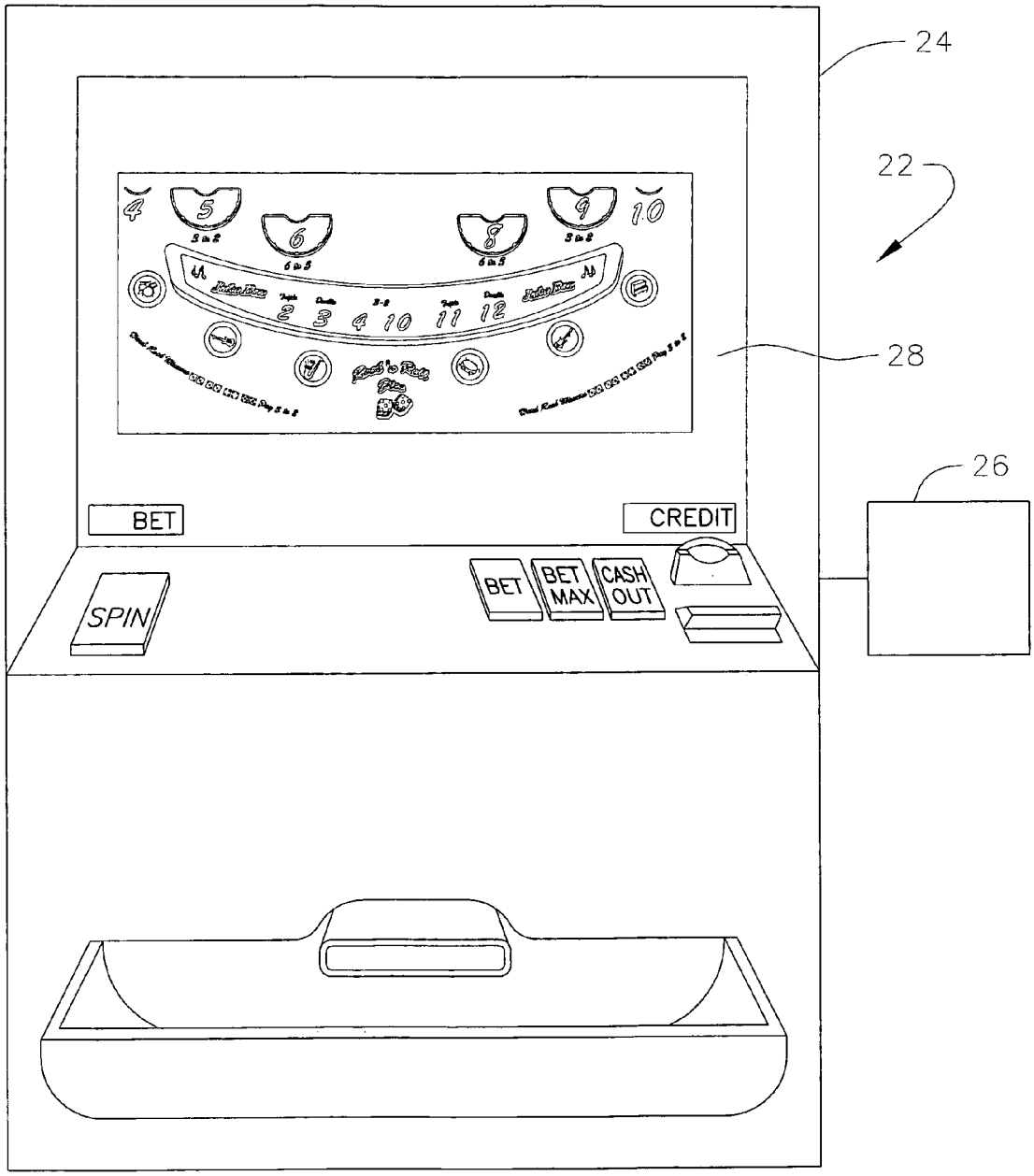
FIG. 2 shows a device for play of the game.
Figure 3:
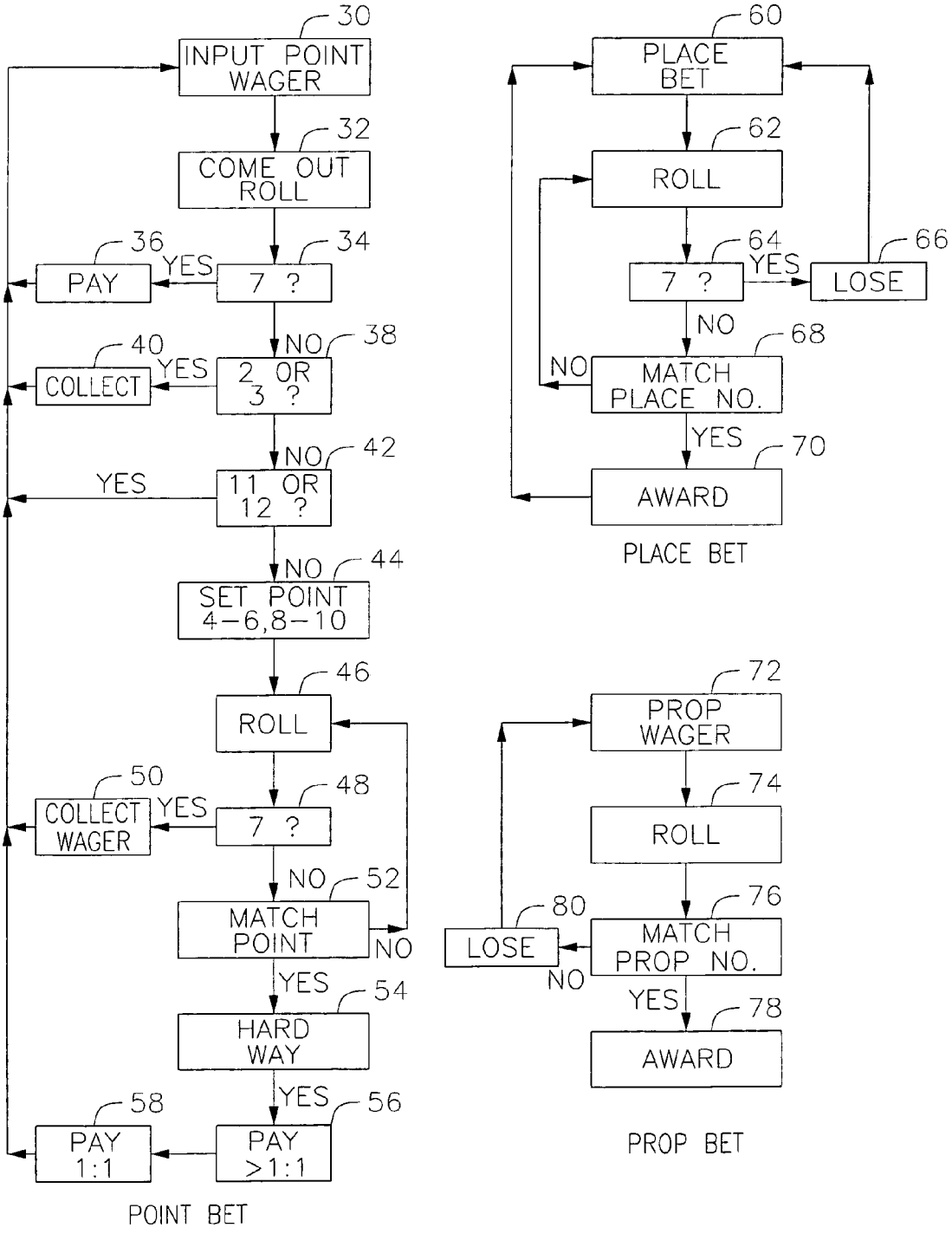
FIG. 3 shows logic diagrams for determining the outcomes of the wagers for the game.

The game method described above may also be incorporated into an electronic device such as a computer, hand held device or a specially adapted video gaming device 22 as shown and described in FIGS. 2 and 3. The device 22 has a housing 24 to contain a game controlling processor 26 as well as support a game video display 28. Preferably the display 28 is a touch screen display. The processor is configured to control the display 28 to display a representation of the layout 10 for the player to make the various desired bets. The device 22 also includes means for accepting bets and for dispensing awards, of the type generally known in the art.

The processor 26 is programmed to control the play of the game by the device 22. With reference to FIG. 3, to play the game the player at 30 inputs their desired point bet (and any proposition bet) and the processor 26 is prompted to randomly select, as by simulating a roll of a pair of dice, an outcome between 2 and 12 representing at 32 as the come out roll. At 34, if the outcome is a 7, at 36 the player is paid based on their point bet and the player is prompted to input another wager for a new come out roll. If the number is not a 7, the outcome is tested at 38 to see if it is a 2 or 3 and if it is, at 40 the player's point bet is lost and collected and the player is prompted to input a new point bet. If the come out roll is not a 7, 2 or 3, at 42 the come out roll is tested to see if it is an 11 or 12. If it is, the processor 26 is prompted to select a new come out roll outcome. This process for the come out roll is repeated until a come out roll outcome is a point (number of 4-6, 8-10) whereupon at 44 the point number is set.

After the point number has been set, the processor 26 is sequentially prompted by the player to, at 46, sequentially roll the dice (randomly select outcomes). After each roll, at 48 the outcome is tested to see if it is a 7. If it is, the player's point bet is lost and at 50 collected and the player is prompted to make a new point bet and start the game over. If the outcome is not a 7, the outcome at 52 is tested to see if the outcome matches the set point number. If not, another number is rolled. This process is repeated until either a 7 is rolled (player loses) or the point number is rolled (player wins the point bet). If the point number is an even number (4, 6, 8 or 10), at 54 the outcome is tested to see if the point has been made the hard way. If the point was made the hard way, the player is paid at 56 odds greater than 1:1. If not, the player is at 58 paid at even money and the player is prompted to enter a new point bet and returned to the start of the game.

With continuing reference to FIG. 3, the processor 26 is further configured to provide for place bet wagers. To make such a bet (after the point number has been set), the player indicates which place bet number to bet upon by suitable input means such as buttons, mouse, keyboard or touch screen display and he amount of the wager at 60. The processor 26 is prompted and at 62 randomly selects an outcome representing a roll of the dice. The outcome is tested at 64 to see if the outcome is a 7. If the outcome is a 7, at 66 all of the player's place bets are lost (as well as their point bet) and the player is returned to the start of the game to make a new point bet. If the outcome selected is not a 7, at 68 the outcome is tested to see if it matches a bet upon place bet number. If not, a new outcome is selected. If the selected outcome does match, at 70 the player is issued an award. Hence, for the place bets, outcomes are selected until the outcome is a 7 (player loses) or it matches the bet upon place bet number at which time the player received an award. Thus the player may make and win as many place bets (within the rules of the game) until the outcome is a 7 at which time all place bets are lost.

With reference to FIG. 3, the processor 26 is also configured to accommodate the any time, one time, first, and if provided, second proposition bets. At 72 the player, using input means, make their proposition bet. At 74 the processor 26 selects the outcome as a next roll of the dice. At 76 the outcome is tested. If the outcome matches one of the group of proposition numbers the player wins and is paid at 78 at least at 1:1 based on their proposition bet and preferably at odds greater than 1:1. If the next roll has not produced one of the group of numbers, at 80 the player loses their one roll proposition bet at 80.

While I have shown and described certain embodiments of the present invention, it should be understood that the same is subject to many modifications and changes. For example, the pay out schedules can be changed to alter the game's performance.

I claim:

1. A method for playing a dice game comprising:

the player making a mandatory point bet to participate in the game;

randomly selecting a come out number between 2 and 12 by rolling a pair of dice, if the number is 7 paying the player 1:1 based upon the point bet, if the number is 2 or 3 collecting the player's point bet, if the number is 11 or 12 declaring the outcome a push and the player neither winning or losing their point bet and if the number is 4-6 or 8-10, that number being declared the point number;

serially selecting outcome numbers between 2 and 12 by rolling a pair of dice, until the outcome number is one of a 7 or the point number, if the number is a 7 the player losing their point wager and if the outcome number is the point number rewarding the player at least 1:1 based on the point wager; and providing place bet wagers on the numbers of 5-6 and 8-9 and excluding the 4 and 10 and subsequent to selection of the come out number the player making a place bet on one or more of the place bet numbers and, during the serial selection of outcome numbers, if the outcome number is a 7 the player losing all place bet wagers and if the outcome number matches a place bet number rewarding the player at odds greater than 1:1.

2. The method of claim 1 comprising rewarding the player for a winning place bet wager based upon the following pay schedule,

| Place Bet Number | Award |
|---|---|
| 5, 9 | 3:2 |
| 6, 8 | 6:5. |

3. The method of claim 1 comprising providing a one time roll proposition wager encompassing the numbers of 2-4 and 10-12 and the player making a proposition wager and if the next outcome is one of 2-4 and 10-12 issuing an award to the player and if said next outcome is not one of 2-4 and 10-12 the player losing their wager.

4. The method of claim 3 comprising rewarding the player for a winning next outcome wager according to the following schedule,

| Number | Award |
|---|---|
| 2, 12 | 3:1 |
| 3, 11 | 2:1 |
| 4, 10 | 3:2. |

5. The method of claim 1 comprising limiting the place bet wagers to the amount of the point wager.

6. The method of claim 1 comprising limiting the place bet wagers to a multiple of the amount of the point wager.

7. The method of claim 1 comprising if the point wager is won the hard way, paying the player at odds greater than 1:1.

8. The method of claim 7 comprising if the point wager is won the hard way, paying the player at odds greater than 3:2.

9. The method of claim 1 comprising the player making a proposition wager that the next outcome will be a 2 or 3 and if the next outcome is one of a 2 or 3 issuing an award to the player based upon said proposition wager.

10. The method of claim 9 comprising issuing an award based upon said proposition wager of approximately 10:1 if the next outcome is a 2 or 3.

11. The method of claim 1 comprising the player making a proposition wager that the next outcome will be one of an 11 or 12 and if the next outcome is an 11 or 12, issuing an award to the player.

12. The method of claim 11 comprising issuing an award based upon said proposition wager of approximately 10:1 if the next outcome is one of an 11 or 12.

13. The method of claim 1 comprising the player making a proposition wager that the next outcome will be one of a 2, 3, 11 or 12 and if the next outcome is one of said 2, 3, 11 or 12 issuing an award to the player.

14. The method of claim 13 comprising issuing an award based upon said proposition wager of approximately 4:1 if the next outcome is one of a 2, 3, 11 or 12.

15. A method for playing a dice game using two dice comprising:

the player making a point bet to participate in the game;

rolling the dice to randomly select a come out number between 2 and 12, if the come out number is 7 paying the player based upon the point bet, if the number is 2 or 3 the player losing the player's point bet, if the number is 11 or 12 declaring the outcome a push and the player neither winning or losing their point bet and if the number is 4-6 or 8-10, that number being declared the point number;

serially rolling the dice to randomly select outcome numbers between 2 and 12 until the outcome number is one of (i) a 7 in which case the player loses their point bet or (ii) the outcome number is the point number in which case the player wins the point wager and is issued an award and (iii) if the outcome number is the point number and is the hard way, paying the player at odds greater than 1:1; and providing place bet wagers on the numbers of 5-6 and 8-9 and excluding the 4 and 10 and subsequent to selection of the come out number the player making a place bet on one or more of the place bet numbers and, during the serial selection of outcome numbers, if the outcome number is a 7 the player losing all place bet wagers and if the outcome number matches a place bet number rewarding the player for that place bet at odds greater than 1:1.

16. The method of claim 15 comprising providing a first proposition wager encompassing the numbers of 2-4 and 10-12 and the player making said first proposition wager and if the next outcome is other than one of 2-4 and 10-12 the player losing their first proposition wager and if said next outcome number is one of 2-4 and 10-12 issuing an award based upon said first proposition wager to the player at odds greater than 1:1.

17. The method of claim 16 comprising rewarding the player for a winning first proposition wager according to the following schedule,

| Number | Award |
|---|---|
| 2, 12 | 3:1 |
| 3, 11 | 2:1 |
| 4, 10 | 3:2. |

18. The method of claim 15 comprising providing a second proposition wager selected from the group consisting of at least one of (i) that the next outcome number will be one of a 2 or 3, (ii) that the next outcome number will be one of an 11 or 12 or (iii) that the next outcome number will be one of a 2, 3, 11 or 12, the player making said second proposition wager and if the next outcome number matches the number of the selected group, issuing an award to the player.

19. A device for playing a dice game comprising:

a computer processor including means for randomly selecting numbers between 2 and 12, and a data structure storing data representing winning outcomes;

a video display;

a wager input device for a player to input a point wager and prompt play, said processor configured to, upon prompting of play, (i) randomly select and display a first outcome number between 2 and 12, and compare the first outcome number to data stored in the data structure for resolving the point wager configured according to the table of,

| First number outcome | Result |
|---|---|
| 2–3 | Collect and retain the player's point wager |
| 7 | Issue an award to the player |
| 11, 12 | No action on Point wager |
| 4–6 and 8–10 | Set the number as the Point, |

means for serially prompting the processor to randomly select numbers between 2 and 12, said processor configured to collect the player's point wager when the selected number is a 7 and to issue an award when the selected number matches the point number;

a device for the player to, after setting the point number to make a place wager on one or more of the number of 5, 6, 8, 9 only; and said processor configured to compare serially selected number and if the number 7 is selected, collect all of the player's place wagers and if the number selected matches a place bet number wagered upon, issue an award to the player.

20. The device of claim 19 comprising said data structure configured to award the player based upon their place bets according to the schedule of,

| Place Bet Number | Award |
|---|---|
| 5, 9 | 3:2 |
| 6, 8 | 6:5. |

21. The device of claim 19 comprising a device for a player to make a multi-number, first proposition wager encompassing the numbers of 2-4 and 10-12; said processor configured to compare the next number selected and if said next number selected is one of 2-4 and 10-12; issuing an award to the player and if the next selected number is not one of 2-4, 10-12 collect said first proposition wager.

22. The device of claim 21 comprising said processor data structure configured to issue an award based upon said first proposition wager according to the schedule of,

| Number | Award |
|---|---|
| 2, 12 | 3:1 |
| 3, 11 | 2:1 |
| 4, 10 | 3:2. |

23. The device of claim 21 comprising a device for a player to make a multi-number, second proposition wager encompassing numbers selected from at least one group consisting of (i) 2 or 3, (ii) 11 or 12 or (iii) 2, 3, 11, or 12, said processor configured to compare the next number selected and if said next number outcome is one of numbers for the selected group issuing an award to the player, otherwise said processor configured to retain the player second proposition wager.

* * * * *